United States Patent [19]

Holabeck et al.

[11] Patent Number: 4,589,348

[45] Date of Patent: May 20, 1986

[54] RETROFITTED RAILWAY CAR AND METHOD OF PRODUCING SAME

[75] Inventors: Gus D. Holabeck, Johnstown; William A. Mullen, Berwyn; Charles M. Smith, Strafford; V. Terrey Hawthorne, Radnor, all of Pa.

[73] Assignee: Portland General Electric Company, Portland, Oreg.

[21] Appl. No.: 544,731

[22] Filed: Oct. 24, 1983

[51] Int. Cl.[4] ..... B61F 1/10; B61F 5/16; B61D 3/00

[52] U.S. Cl. ..... 105/228; 105/199 C; 105/244; 105/406 R; 105/420

[58] Field of Search ..... 105/199 R, 199 C, 200, 105/226, 228, 406 R, 413, 414, 419, 420, 227, 244, 409, 410, 411

[56] References Cited

U.S. PATENT DOCUMENTS 3,240,168 3/1966 Charles et al. ..... 105/406 R
3,713,400 1/1973 Teoli ..... 105/406 R
3,777,671 12/1973 Miller et al. ..... 105/420
3,964,399 6/1976 Miller et al. ..... 105/411 X
4,236,459 12/1980 Teoli ..... 105/244 X

*Primary Examiner*—Robert B. Reeves
*Assistant Examiner*—David F. Hubbuch
*Attorney, Agent, or Firm*—Klarquist, Sparkman, Campbell, Leigh & Whinston

[57] ABSTRACT

A gondola tub type railway car having an arrangement for transferring payloads from the car side panels more directly to the bolsters. The car at each end has a lower bolster for support by a car truck, and an upper bolster secured to the lower bolster preferably through a shear plate. A center plate unit extends upwardly from the lower bolster into the upper bolster and is secured to the latter. The car, at each end, is provided with a reaction beam located inboard of the associated bolster, and is secured to the shear plate and to side members, and cooperates with the bolster in resisting the couple created by draft and buff forces acting in offset relation to the plane of the shear plate.

6 Claims, 9 Drawing Figures

FIG. 3
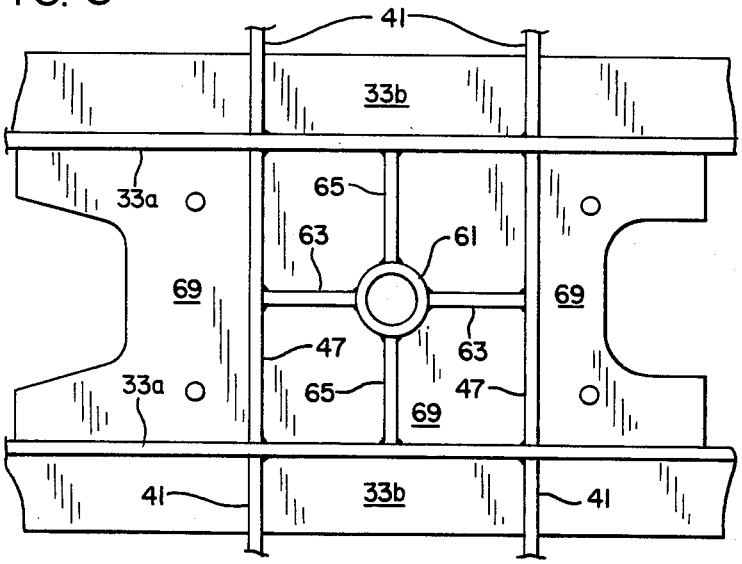
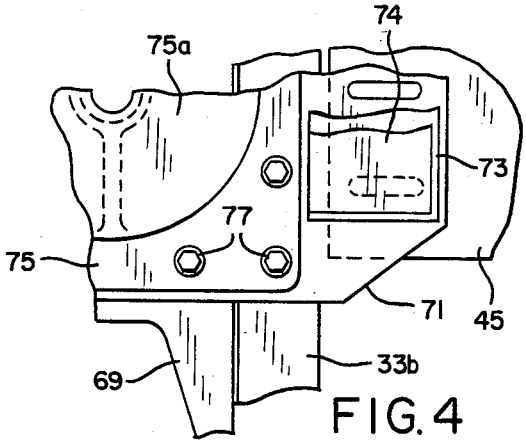
FIG. 4
FIG. 9
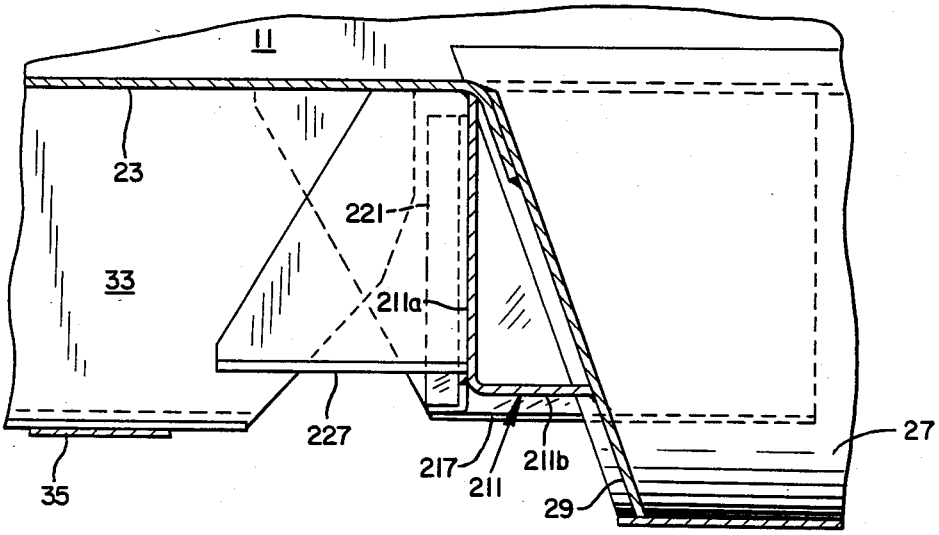

RETROFITTED RAILWAY CAR AND METHOD OF PRODUCING SAME

This invention relates to gondola railway cars and particularly to one having a dropped center or bathtub and which is intended for rotary dumping such as when used for hauling coal.

The capacity of a gondola car can be substantially increased by interrupting the draft or center sill and providing between the trucks a depressed belly section sometimes referred to as a "bathtub". A railway car of this type is shown in the patent to Charles et al, U.S. Pat. No. 3,240,168. A later version is shown in the patent to Teoli U.S. Pat. No. 3,713,400.

A number of such railway cars were produced for Portland General Electric Company with the assurance that they could stand the rugged structural stresses to which they would be subjected. The specific cars under consideration had a depressed belly section of the general type referred to in the above patents, leaving stub draft sills beneath horizontal shear plates. The contents of the car were contained laterally by side panels, and longitudinally by end panels, the latter being inclined downwardly and inwardly in a direction longitudinally of the car. The end panels were welded at their lower ends to the associated shear plates. Reinforcement in the form of diagonal gusset-like V braces were provided and welded to top surfaces of the shear plates and to the exterior faces of the end panels, and at their upper ends to the side panels.

The car body was supported by a pair of trucks, one under each end of the car. Each truck frame directly supported a center plate, which was a part of a cross bolster, located just inwardly of the associated end panel.

Cars of the type just described, after being in use for awhile, commenced developing cracks in various places, making them unfit for further safe usage.

The present invention provides a way of making the cars once again serviceable by converting or retrofitting them to eliminate altogether, or at least reduce to a substantial extent, the structural deficiencies which previously led to structural failures.

It was discovered that the problems were due to a number of structural anomalies, an important one being the manner in which the payload was transmit ted from the side panels to the center plates. It was found that vertical loading and eccentric loading during car rocking and truck hunting was transmitted indirectly from the side panels to the bolsters and center plates by a path leading through the V-braces, through the shear plates, through the stub sills and finally into the bolsters and center plates.

Another structural anomaly was found to be that the railway car could not handle properly the draft eccentricity between the drawbar couplers and the shear plates.

We discovered that we could resolve the first problem by providing a more direct route of load transference, which was accomplished by providing (1) at each existing bolster, an upper bolster located above and welded to the shear plate in overlying relation to the existing bolster, and (2) an improved center plate and vertical center filler assembly, which, along with the shear plate, unifies the upper and existing bolster, enabling them to assume the major portion of transferring the payload from the side panels to the center plate. We also "softened" the V-braces by forming openings in them so that they no longer attempted to assume a substantial portion of the payload, in its transference to the bolsters.

The second problem was solved by providing a reaction beam above and welded to the shear plate, inboard of the new upper bolster.

When the retrofitting was completed, it was discovered that not only had a procedure been provided for retrofitting existing railway cars to put them back in service, but to provide a superior design for newly manufactured railroad cars.

It is a main object of the present invention to provide an improved bathtub type gondola car and particularly one in which the stresses caused by the draft-load vertical eccentricity, and the payload horizontal eccentricity are handled in a superior fashion, both as regards retrofitted and new cars.

Various other objects of the invention will be apparent from the following description taken in connection with the accompanying drawings, wherein:

FIG. 3 is a fragmentary top view of the central portion of FIG. 2, taken in the direction of the arrows 3—3, with parts broken away for convenience in illustra- tion;

FIG. 4 is a bottom fragmentary view of the central portion of FIG. 2, taken in the direction of the arrows 4—4 of FIG. 2;

FIG. 9 is a fragmentary cross sectional view taken along lines 9—9 of FIG. 7.

Figure 1:
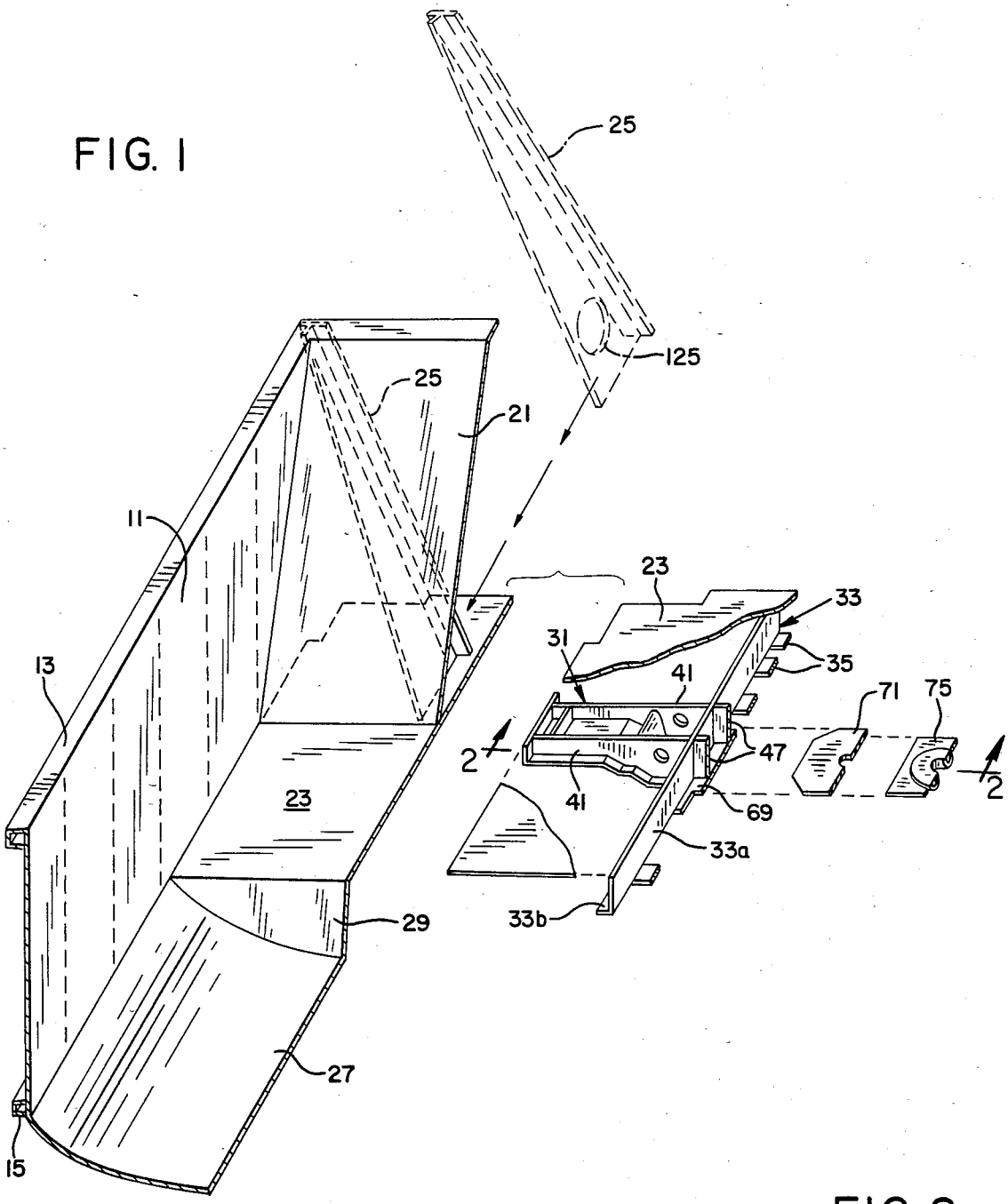
FIG. 1 is an exploded perspective view of an approximate quarter section of a car prior to conversion.

FIG. 1 shows a quarter section of a gondola car of the present invention, with the trucks and coupling assemblies removed. The car includes a pair of side panels, a part 11 of one being shown, as having a top chord 13 and a side sill 15. The car also has a pair of end panels, each being inclined longitudinally inwardly as shown for end panel part 21. Extending between the side panels at each end of the car is a shear plate 23 which is welded to the side and end panels at the places of contact. A pair of V-braces 25 are provided at each end of the car, one being shown in FIG. 1. Each is welded to the associated shear plate, the associated end panel and the associated side panel at the places of contact.

The car has a drop center provided by a curved trough section or bathtub 27 which is welded to the side sills 15 and is closed at each of its ends by an end plate 29.

Figure 2:
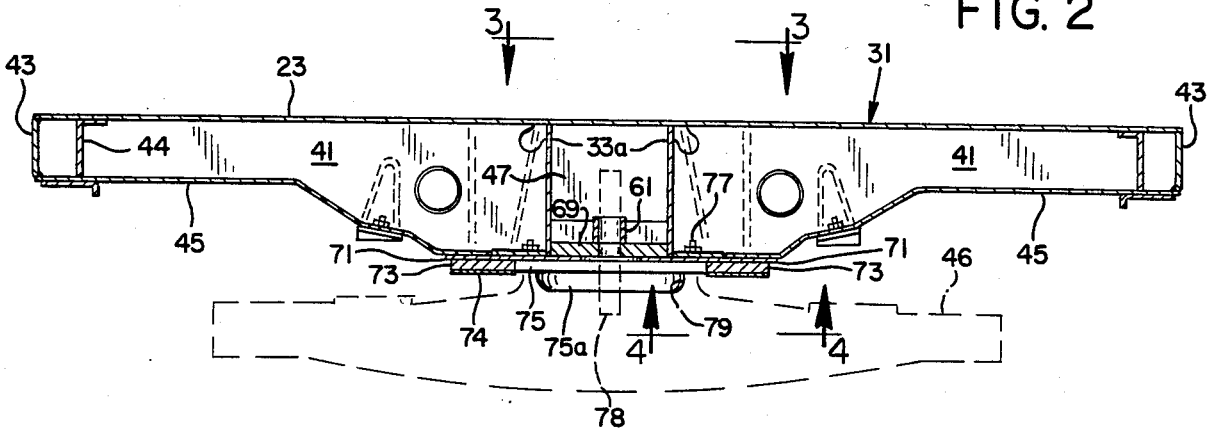
FIG. 2 is a cross section taken along lines 2—2 of FIG. 1, through the bolster, with a truck in dotted lines therebeneath.

FIG. 1 also shows, to one side of the body section, a bolster-sill assembly, which, in fact, symmetrically underlies the shear plate 23, and is welded at its upper edges to the underside of the shear plate (see Fig. 2). The assembly includes a cross bolster, generally entitled 31 (compare FIGS. 1 and 2) which, in a longitudinal sense, is located just inwardly of the lower edge of the associated end panel 21, but is disposed below the shear plate rather than above the shear plate, as is the end panel.

The bolster-sill assembly includes a stub or draft sill 33 which comprises a pair of parallel laterally spaced center stub sill elongate plate members 33*a*, only one of which is shown in FIG. 1, while both are shown in FIG. 2. The sill members 33*a* are joined at their lower edges by plural connecting bottom pieces 35, and by other structure to be mentioned shortly. The sill 33 and the bolster 31 cross one another at the central portion of the bolster. The sill, in fact, extends through the bolster, with contacting portions of the bolster being welded to the stub sill.

The bolster 31 is a fabricated unit which is made up of a number of parts, including at each side of each center stub sill, a pair of side members or webs 41 (FIGS. 1 and 2), an end member 43, one or more cross members 44, and a formed bottom cover plate 45. Between the sill members 33*a* are a pair of connecting plates 47 which form continuations of the side members 41. The side members 41 deepen toward the sill, and the bottom cover plate 45 follows the contour of the lower edges of the side members.

The railway car is supported, as previously indicated, by two trucks, one at each end of the railway car (shown at 46 in dotted lines in FIG. 2). To be more precise, it is the bolster 31 at each end of the car which is in bearing engagement with the associated truck 46. Each bolster has a center structure (FIGS. 2 and 3), which includes the connecting plates 47 and a central sleeve 61. The latter is connected to the plates 47 and to the associated sill members by connecting pieces 63 and 65, respectively. This center structure also includes a heavy bottom plate 69.

Beneath the center structure is a sole plate 71 whose shape is better shown in FIGS. 1 and 4. It is welded to the bottom cover plate 45 of bolster 31, to the bottom flanges 33*b* of the sill, and to the bottom plate 69. The purpose of the sole plate will be presently explained.

Filler plates 73 provide adjustment and reinforcement for the center plate extension pad loads beneath the sole plate on opposite sides of the center line of the bolster (compare FIGS. 2 and 4). The plates 73 carry wear plates 74.

Concentric with the center line of the bolster and of the truck is a heavy center plate 75 which is secured by bolts 77 (FIG. 2) to the underside of the sole plate. The center plate has a central opening concentric with the hole in the sleeve 61, and with holes in the sole plate 71 and the bottom plate 69, for reception of a center pin 78. The latter projects down into the truck. The truck bolster 46 has a center bowl 79 which receives a downwardly projecting circular portion 75*a* of the center plate in standard fashion.

The sole plate 71 provides integrity for the bottom cover plate 45 of the bolster, because that integrity is interrupted by the continuity of the stub sill through this intersection.

It is with the structure above described that problems have arisen. Cracks have developed at a number of places indicating excessive stresses. The question arose as to whether the cars could be saved with minimal alteration. It was particularly desirable to accomplish this, with as little weight addition as possible, because for each pound added, one pound of payload is lost on each trip.

After long study and soul searching, a solution has been found. First, it was discovered that the problems were in part due to the way that the payload was transferred from the side panels to the center plates, and secondly, in part due to the inability of the structure to withstand stresses created by longitudinal loads known as buff and draft forces. The solution to the first problem was found to lie in altering the construction so as to eliminate, or at least greatly reduce, a discovered circuitous routing of payload to the center plates, which imposed excessive stresses on certain areas; while the solution to the second problem was found to lie not so much in strengthening the sills as in strengthening the shear plate and providing a reaction member at a place inwardly of the bolster to accept and transfer moment couple loads.

To convert a car, the car body is lifted off the trucks and inverted and supported in this position for much of the work. While it could be left upright, the inverted position is usually chosen for several operations because of certain access advantages. For convenience in explanation, in the following description, the car will be referred to as if it were upright.

At each end of the car, the center plate is unbolted and removed. Then, by means of suitable cutting torch procedures, the central structure within the stub sill, as well as the sole plate with associated filler and wear plates is removed. The removed structure thus includes connecting pieces 47 (FIGS. 1 and 3), connecting pieces 63 and 65 and sleeve 61, together with the heavy bottom plate 69, sole plate 71, and the filler plates 73, together with the associated wear plates 74.

The above removal procedure leaves a vertical cavity in the center of the stub sill 33 at the former location of the central structure. The sill 33 remains intact, but the inner faces of the sill members 33*a*, where the central structure was removed, are ground smooth, as are the bottom faces of the bolster where the sole plate was removed. Next, for a purpose to be presently apparent, a rectangular opening is formed in the shear plate 23, which, with the cavity, provides a passage or throughhole in the center of the bolster.

Figure 5:
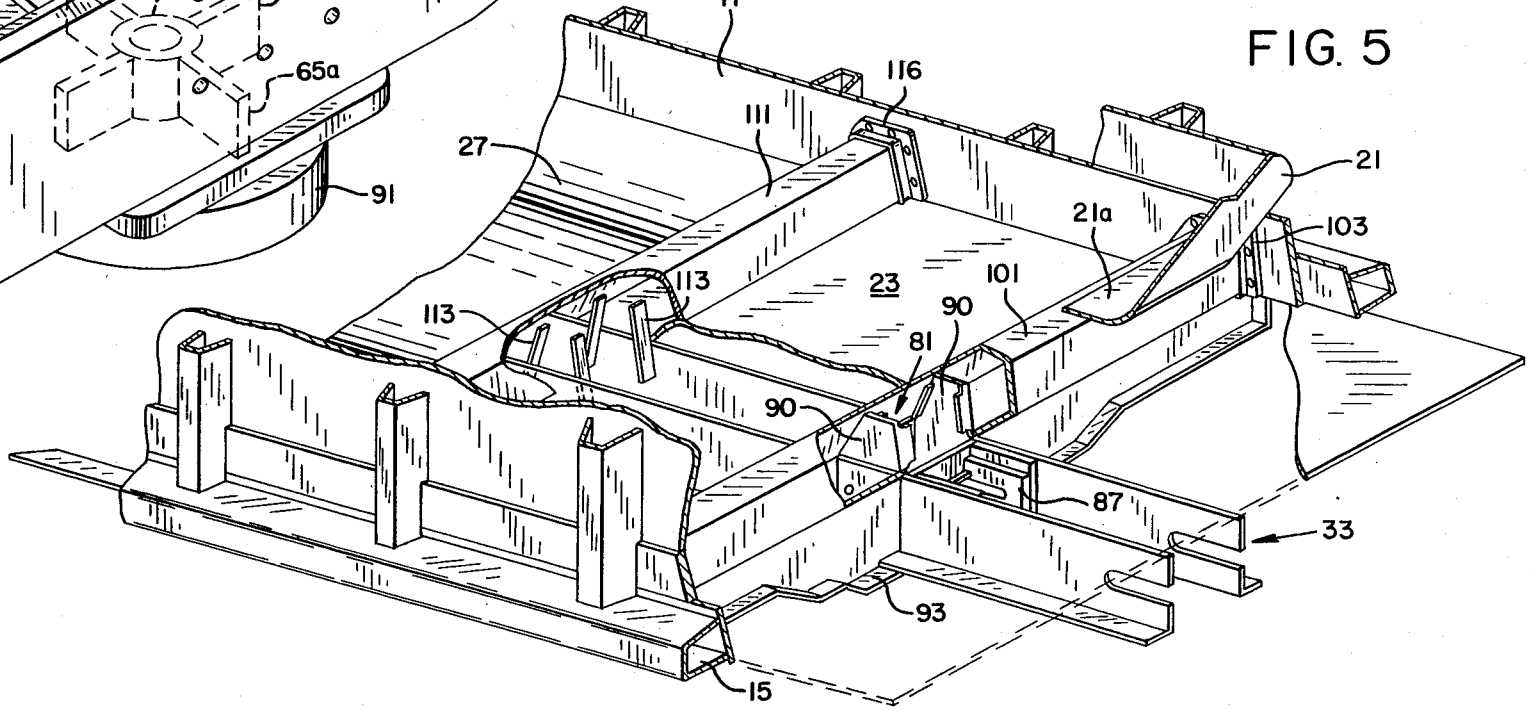
FIG. 5 is a perspective view showing part of an end portion of a car after conversion.
Figure 6:
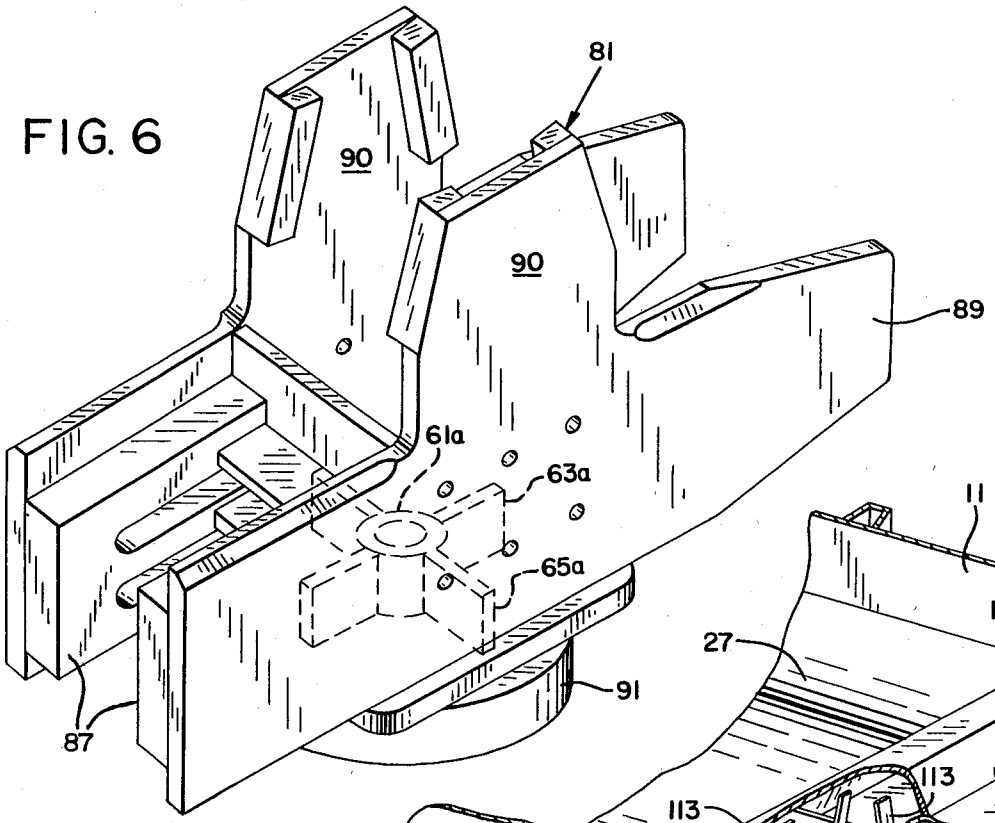
FIG. 6 is a perspective view of the center filler assembly of the invention.

Now, referring to FIGS. 5 and 6, a fabricated but fully integrated center unit 81 is mounted in place. It has a pair of draft stops 87, horizontal extensions 89, and a pair of vertical lugs 90, whose purpose will presently appear. It also has a center sleeve 61*a* and connector pieces 63*a* and 65*a* and has a center plate 91. The width of the center unit 81 is just slightly less than the distance between the sill members 33*a*.

To mount the center unit 81, it is moved into the cavity in the stub sill, from the bottom of the car, to project the pairs of lugs 90 through the rectangular opening formed in the shear plate, while abutting the draft stops 87 and the extensions 89 against the underside of the shear plate. The center unit is then welded to sill 33.

The height of the draft stops is such as to dispose the center plate 91 below the bolster in the same position as occupied by the removed center plate 75, i.e., in position to properly seat center plate 91 in the socket 79 provided by the truck bolster 46.

Next, a new, heavier sole plate 93 (FIG. 5) having a central opening of a size to pass over the center plate 91, is placed against the underside of the bolster and sill, in surrounding relation to the center plate 91, and is welded to the contacting portions of the bolster and sill.

Then an upper bolster 101 (FIG. 5) of elongate form, and of inverted U shape in cross section, is seated onto the vertical lugs 90 in transverse relation to the car, and is welded to the lugs and to the shear plate 23. An attaching piece, in the form of a horse collar 103, is then fitted on each end of the bolster in engagement with the inner faces of side panels 11. The horse collars are then welded to the upper bolster. Holes, matching those in the horse collars, are drilled in the side panels, and then the horse collars are bolted to the side panels.

At some time prior to the application of the center unit 81 and the upper bolster, a lower strip is removed from the end panel 21 (FIG. 5). After the upper bolster is secured in place, a transition piece 21*a* is fitted into place with one edge portion resting on the top of the upper bolster 101, while the other edge portion is abutted against the lower free edge of the end panel 21. The transition piece is then welded to the just mentioned members, and also to the side panels at the end portions of the transition piece.

Now, a reaction beam 111, which is like upper bolster 101, is mounted in place in spaced relation inwardly of the upper bolster 101, just short of the associated end plate 29 of the tub section of the car. First, rectangular openings are formed in the shear plate 23 to accommodate two pairs of mounting pieces 113 (FIG. 5), which are shown in the form of angle irons. These pieces are bolted to the inner faces of the sill 33, in upwardly generally converging relation to conform to the inner faces of the reaction beam, and are also bolted to the reaction beam: The lower edges of the reaction beam are welded to the shear plate, preferably after the mounting pieces 113 are bolted to the reaction beam, but, at this time, merely clamped to the sill 33.

A pair of horse collars 116 are then welded to the ends of the reaction beam and bolted to the side panels in the fashion described for horse collars 103.

At some time during the conversion process, sizable holes 125, indicated in dotted lines for the separated V-brace 25 in FIG. 1, are formed in such V-braces.

With the conversion completed, the car now handles the stresses imposed on it quite differently than previously. The payload, imposed by the tub on the side panels 11, no longer is transmitted primarily to the bolster 31 in circumferential fashion, i.e., through the V-braces 25 and end panel 21, down to the shear plate 23, and then back through the sill to the center plate. Instead, by weakening the V-braces 25, the stresses now look for a new route and find it directly through the upper bolster 101 and lower bolster 31, which by both being welded to the shear plate 23 to function to accept the major portion of the payload directly from the side panels, with some assistance from the reaction beam 111. While a small portion of the payload may still travel through the V braces 25 and end panel 21, the magnitude of the stresses within the members is not sufficient for repeated loads to cause fatigue fracture of the bolster side members or damage the sill.

The buff and draft forces are also handled differently. Previously, because of the vertical offset between the line of action of such forces and the shear plate, a considerable couple was applied to the bolster and shear plate to frequently damage them.

With the new arrangement, the couple previously applied to old bolster 31 is now resisted by the reaction beam and the new composite bolster 31–101, which together assume the stresses without undue strain being imposed on the shear plate or bolsters.

Figure 7:
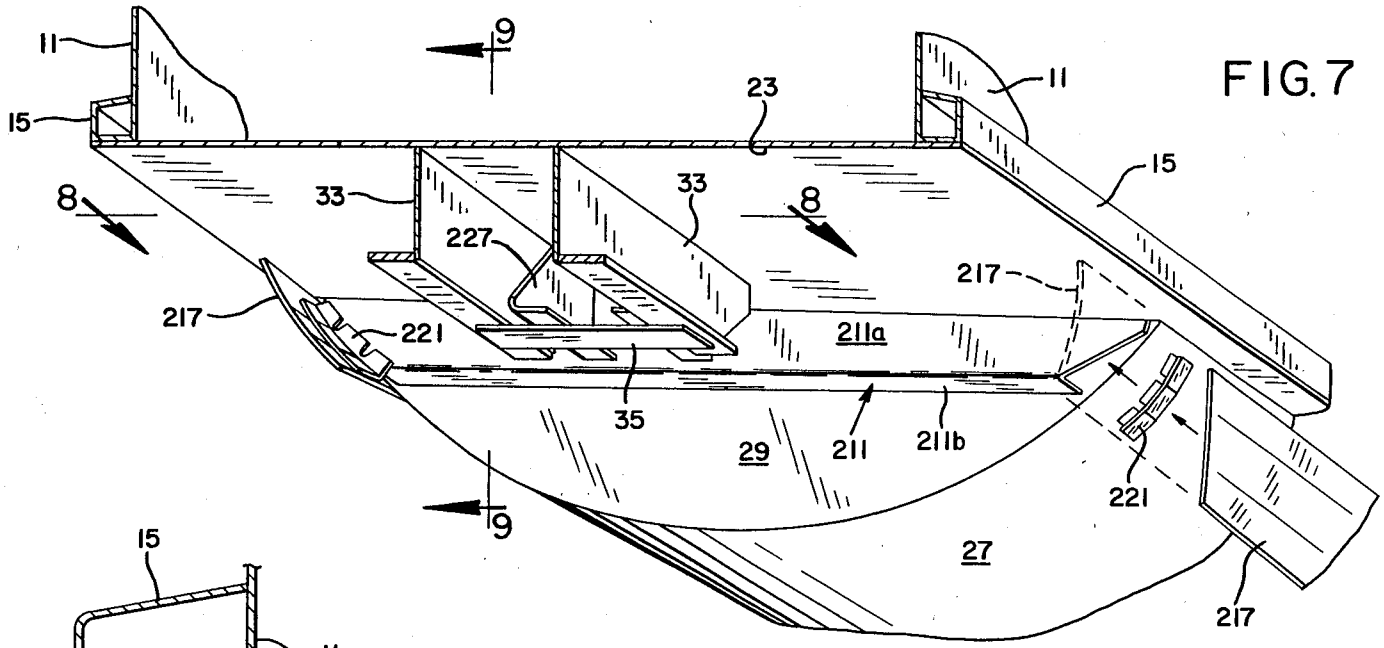
FIG. 7 is a perspective view of part of the underside of a car showing a modified form of the invention.
Figure 8:
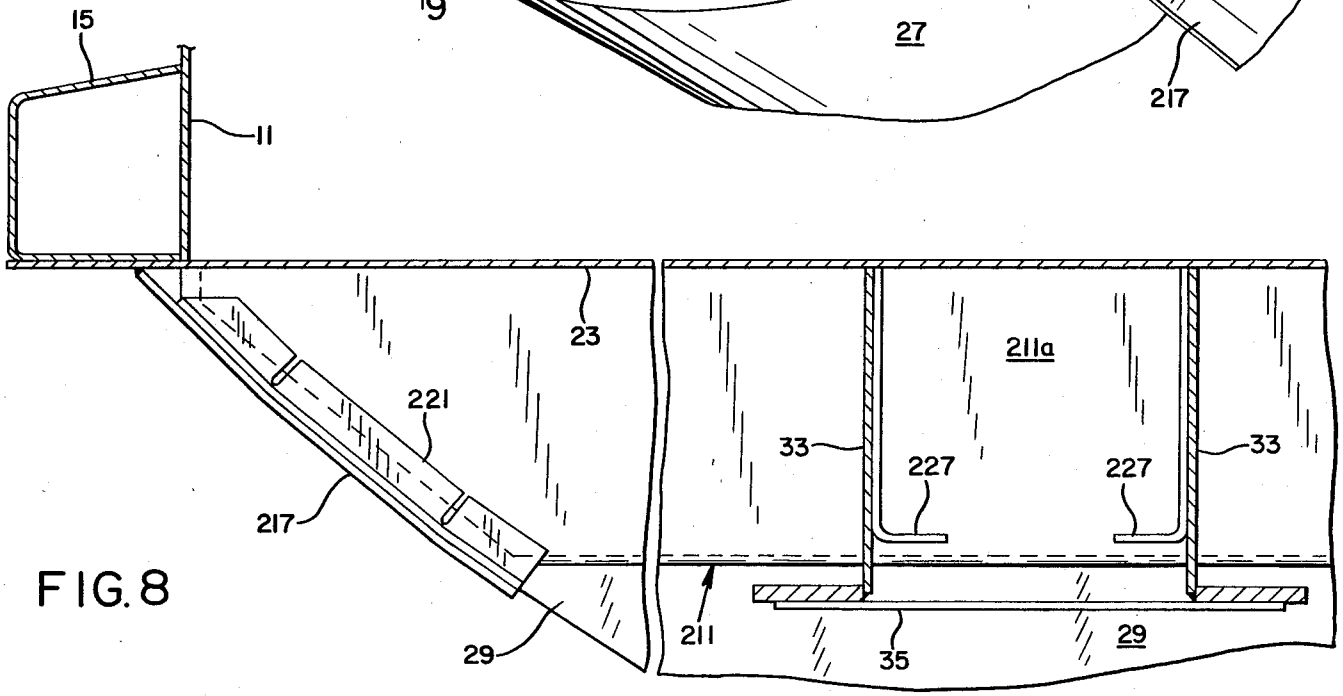
FIG. 8 is a fragmentary cross sectional view taken along lines 8—8 of FIG. 7, on an enlarged scale.

FIGS. 7–9 show a second form of the invention which improves the original construction substantially, but to a somewhat leser extent, in certain respects, than the first form of the invention.

In the second form, the original construction is left intact insofar as the original bolster 31 is concerned, and no auxiliary bolster 101, such as used in FIGS. 5 and 6, is employed. Also the V-braces 25 are left intact (no holes 125 being formed therein). Thus, the payload is transmitted to the bolster 31 in substantially the same fashion as in the original construction.

What the second form does is to provide additional structure to aid in resisting the couple created by the horizontal drawbar eccentricity. Instead of adding a reaction beam 111 above the shear plate 23, we find that we can use a reaction beam located below the shear plate.

FIGS. 7–9 show the modification at one end of the car. The opposite end is similarly modified. A reaction beam member 211 of angular form is provided and is located between the inboard ends of the stub sill members 33 and the tub end plate 29. The vertical flange 211*a* of the beam is welded at its upper edge to the underside of the shear plate 23, while the horizontal flange 211*b* is welded at its inboard edge to the end plate 29.

The reaction beam 211 has its ends connected indirectly to the side sill 15, as follows: tub extension plates 217 overlap and are welded to the exterior of the curved portions of the tub 27 at each side, and project in an outboard direction somewhat beyond the plane of the vertical flange 211*a* of the reaction beam 211. Rather than trying to form the ends of the reaction beam to the exact curvature of the tub extensions, the beam ends are cut off (or formed) to terminate short of and only in approximate conformance to the inside faces of the tub extenders. Then, an angle connector 221 is provided for each end of the beam and is nested in the corners provided by the adjacent portions of the vertical flange 211*a* and the associated tub extension and welded to such portions.

The second form of the invention further includes, at each end of the car, a pair of sill member extension elements 227 of angular form, which overlap the inboard ends of the sill members and are welded thereto. The inboard ends of the sill-member extenders abut against, or terminate in a contiguous relationship to, the vertical flange 211*a* of the reaction beam and are welded thereto.

In operation, instead of the couple, created by the draft and buff forces, being resisted solely by the origlnal bolster 41, and to some extent by the V-braces 25, the couple is now additionally resisted by the reaction beam 211, which coacts with the other structure to effectively prevent the damage which previously occcurred.

It is true that the second form of the invention leaves the transfer of the payload to the bolster 41 substantially as it was, although the reaction beam and its connections accept a part of such transfer. Nevertheless, the two forms of the invention give options to those who are either converting existing cars or producing new cars. If the payloads are going to be very substantial indeed, then the first form of the invention would normally be elected. However, if the payloads are less, the second form of the invention can be elected because it is substantially less expensive than the first form.

However, where finances are at a premium, or need to be spread over a period of time, a converter or manufacturer may be required to elect the second form of the invention because it costs less initially. If the transfer of payloads causes damage to the car subsequently, the damage can be repaired as it occurs with later obtained finances.

What is claimed is:

1. In a tub type gondola railroad car having side panels, end panels, and a tub portion flanked longitudinally by shear plates, a transverse lower bolster unit for each end of the car, with each unit being disposed below but secured to the associated shear plate, a transverse upper bolster unit for each end of the car disposed in register with the associated lower bolster unit and disposed above and secured to the associated shear plate, each bolster unit being secured at its ends to said side panels, each lower bolster unit having a center plate unit, each shear plate having an opening therein in register with said center plate unit, said center plate unit projecting upwardly through the associated opening into the associated upper bolster unit and being secured thereto.

2. A railroad car as recited in claim 1 in which there is a reaction beam for each car end, disposed above the associated shear plate and secured thereto and also secured at its ends to said side panels, each reaction beam being disposed inboard of the associated upper bolster unit and cooperating with the latter in resisting the couple created by the draft and buff forces acting in offset relation to the plane of the associated shear plate.

3. In a tub type gondola railroad car having side panels, end panels, and a tub portion flanked longitudinally by shear plates, a transverse lower bolster unit for each end of the car secured to the associated shear plate and adapted for engagement with a truck bolster, a transverse upper bolster unit for each end of the car disposed in register with the associated lower bolster unit, each upper bolster unit being secured at its ends to said side panels, each lower bolster unit having a center plate unit projecting upwardly into the associated upper bolster unit and being secured thereto.

4. A railroad car as recited in claim 3 in which there is a reaction beam for each car end, disposed above the associated shear plate and secured thereto, and also secured at its ends to said side panels, each reaction beam being disposed inboard of the associated upper bolster unit and cooperating with the latter in resisting the couple created by draft and buff forces acting in offset relation to the plane of the associated shear plate.

5. In a tub type gondola railroad car having side panels, end panels, and a tub portion flanked longitudinally by shear plates, a transverse bolster unit for each end of the car secured to the associated shear plate and adapted for engagement with a truck bolster, a reaction beam for each car end and secured to said shear plate and disposed inboard of the associated bolster unit and cooperating with the latter in resisting the couple created by draft and buff forces acting in offset relation to the plane of the associated shear plate, said bolster unit and reaction beam each being secured at its ends to said end panels, a draft sill beneath the shear plate, and the reaction beam being located below said shear plate interposed between the inboard end of the draft sill and the tub portion and being fixedly secured to said tub portion, the shear plate, and the draft sill.

6. A railroad car as recited in claim 5 in which the sides of the tub portion have extensions to which the ends of the reaction beam are fixedly secured.

* * * * *